US005391448A

United States Patent [19]

Katayama et al.

[11] Patent Number: 5,391,448

[45] Date of Patent: Feb. 21, 1995

[54] ELECTROPHOTOGRAPHIC PHOTOCONDUCTOR AND A METHOD FOR MANUFACTURING THE SAME

[75] Inventors: Satoshi Katayama; Yoshihide Shimoda, both of Nara; Makoto Kurokawa, Kitakatsuragi, all of Japan

[73] Assignee: Sharp Kabushiki Kaisha, Osaka, Japan

[21] Appl. No.: 79,050

[22] Filed: Jun. 21, 1993

[30] Foreign Application Priority Data

| | | | |
|---|---|---|---|
| Jun. 22, 1992 | [JP] | Japan | 4-162935 |
| Aug. 19, 1992 | [JP] | Japan | 4-220484 |
| Nov. 11, 1992 | [JP] | Japan | 4-301127 |

[51] Int. Cl.[6] ..... G03G 5/14

[52] U.S. Cl. ..... 430/65; 430/131

[58] Field of Search ..... 430/65, 131

[56] References Cited

FOREIGN PATENT DOCUMENTS

| | | | |
|---|---|---|---|
| 58-95351 | 6/1983 | Japan . | |
| 62-280864 | 12/1987 | Japan . | |
| 63-234261 | 9/1988 | Japan . | |
| 63-298251 | 12/1988 | Japan . | |
| 210962 | 8/1989 | Japan | 430/65 |
| 2-181158 | 7/1990 | Japan . | |
| 3-259268 | 11/1991 | Japan . | |

*Primary Examiner*—Roland Martin

*Attorney, Agent, or Firm*—Nixon & Vanderhye

[57] ABSTRACT

An electrophotographic photoconductor comprising a conductive support, an undercoating layer formed on the conductive support, and a photosensitive layer laminated on the undercoating layer, wherein the undercoating layer comprises non-conductive titanium oxide particles and a polyamide resin, the non-conductive titanium oxide particles being 80 to 99 wt % of the undercoating layer, and the undercoating layer has a thickness of 0.5 to 4.8 μm.

7 Claims, 3 Drawing Sheets

ELECTROPHOTOGRAPHIC PHOTOCONDUCTOR AND A METHOD FOR MANUFACTURING THE SAME

BACKGROUND OF THE INVENTION

1. Field of the Invention

The present invention relates to an electrophotographic photoconductor which comprises a conductive support, an undercoating layer and a photosensitive layer, and to a method for manufacturing the same.

2. Description of the Prior Art

Generally speaking, the process of electrophotography is one means for recording data using a photoconductive phenomenon observed in a photoconductor. The process of electrophotography is conducted in the following way.

At the outset, the photoconductor is placed in a dark place to be electrostatically charged homogeneously on the surface thereof by corona discharge, followed by exposing an image to selectively discharge an electric charge at an exposing section so that an electrostatic image is formed at a non-exposed section.

Subsequently, colored electrically charged fine particles (toner) are allowed to adhere to the electrostatic image by electrostatic force or the like to form a visible image, thereby forming an electrophotographic image.

Basic properties required for the photoconductive photoconductor for use in electrophotographic technique which undergo these series of processes include the following points:

(1) The photoconductor can be homogeneously charged to an appropriate level of potential in a dark place.

(2) The photoconductor has a high electric charge holding capabilities and only a small amount of electric discharge.

(3) The photoconductor has a high photosensitivity such that irradiating the photoconductor with light causes a quick discharge of an electric charge.

In addition, the photoconductor requires good stability and durability such as:

(4) The electrostatic charge on the photoconductor can be easily removed.

(5) The residual potential is small.

(6) The photoconductor has a mechanical strength and an good flexibility.

(7) In the case of repetitive use, electric properties, particularly charging properties, photosensitivity, residual potential and the like vary little.

(8) The photoconductor has resistance against heat, light, temperature, moisture and ozone deterioration.

Electrophotographic photoconductors currently put on the market as a product are constituted by forming a photosensitive layer on a conductive support. Besides, an undercoating layer is provided between the conductive support and a photosensitive layer for the following purposes:

Inhibiting the generation of image defect resulting from the disappearance and reduction of an electric charge on the surface of the photosensitive layer caused by unnecessary injection of an electric charge into the photosensitive layer from the conductive support, Coating defects on the surface of the conductive support, Improving the charging properties, Improving the adhesiveness of the photosensitive layer, and Improving the coating properties of the photoconductor.

Resins to be used for the undercoating layer include resin materials such as polyethylene, polypropylene, polystyrene, acrylic resin, vinyl chloride resin, vinyl acetate resin, polyurethane resin, epoxy resin, polyester resin, melamin resin, silicon resin, polyvinyl butyral resin and polyamide resin, copolymer resin containing two or more of the above repetitively used units such as vinyl chloride-vinyl acetate copolymer resin, acrylonitrile-styrene copolymer resin, caseine, gelatin, polyvinyl alcohol, ethyl cellulose. Particularly, polyamide resin is said to be preferable (Japanese Laid-Open Patent Publication No. SHO 48-47344, Japanese Laid-Open Patent Publication No. SHO 52-25638, and Japanese Laid-Open Patent Publication No. SHO 58-95351).

The electrophotographic photoconductor using polyamide resin or the like for the undercoating layer thereof has a resistance of about $10^{12}$ to $10^{15}\Omega\cdot$cm with the result that the residual potential is accumulated in the photosensitive layer to generate an overlap of images without reducing the thickness of the undercoating layer to about 1 $\mu$m or less. On the other hand, there was a problem that reducing the thickness of the undercoating layer results in making it difficult to control the thickness of the undercoating layer in the process such that defects on the conductive support cannot be coated and the charging properties of the photoconductor cannot be improved.

In addition, polyamide resin having a favorable adhesiveness with metal cannot be dissolved in general organic solvents. Thus it has an excellent resistance against solvent with respect to the photosensitive layer. On the other hand, it has a drawback that it absorbs a large amount of moisture with the result that the residual potential rises in low temperature and low moisture conditions under the influence of the large moisture absorption.

Further, it has a drawback that the residual potential is accumulated in large quantity and the photosensitivity is reduced in the repetitive use so that image is overlapped, causing a damage to the quality of the image.

Besides, in order to inhibit the image defect and to improve the residual potential, there has been proposed an electrophotographic photoconductor in which is provided an undercoating layer having 1 to 10 weight part of a mixture of titanium oxide and tin oxide-scattered into 100 weight part of 8-nylon (as disclosed in Japanese Laid-Open Patent Publication No. SHO 62-280864) and an electrophotographic photoconductor using titanium oxide fine particles coated with alumina for improving dispersing properties of the titanium oxide (as disclosed in Japanese Laid-Open Patent Publication No. HEI 2-181158).

Thus it has become possible to increase the thickness of the undercoating layer by mixing titanium oxide in the undercoating layer, but there was a problem that the stability in the repetitive use depends on the environmental conditions particularly in low temperature and low moisture environments.

Consequently, it is important to select the most appropriate polymer material out of a large number of such materials in order to provide an electrophotographic photoconductor excellent in repetitive stability and environmental properties wherein the residual potential is accumulated in small amount and photosensitivity reduces a little in repetitive use by providing an undercoating layer between the conductive support and the photosensitive layer to improve the charging properties and residual potential of the photoconductor. That is because when the photosensitive layer contacts the undercoating layer, a charge generation material may come together to cause a failure in coating, thereby generating a drawback of reduction in photosensitivity and uneven quality of images. In addition, resins and metal oxides used in the undercoating layer must be stable both in the combination and the ratio of blend without causing a change in resistance by environmental conditions such as low temperature low moisture and high temperature high moisture. Further, such resins and metal oxides must form a block against a hole injection from the conductive support as well as exhibit a resistance against solvents in the process of forming a photosensitive layer.

SUMMARY OF THE INVENTION

An object of the present invention is to provide an electrophotographic photoconductor excellent in repetitive stability and environmental properties wherein the residual potential is accumulated in a small amount and photosensitivity reduces a little in repetitive use by improving the charging properties and residual potential of the photoconductor.

Another object of the present invention is to provide an electrophotographic photoconductor comprising an undercoating layer having a smooth surface property that allows substantially removing defects on a conductive support and coating homogeneously a photosensitive layer.

The present invention provides an electrophotographic photoconductor comprising a conductive support, an undercoating layer formed on the conductive support, and a photosensitive layer laminated on the undercoating layer, wherein the undercoating layer comprises non-conductive titanium oxide particles and a polyamide resin, the non-conductive titanium oxide particles being 80 to 99 wt % of the undercoating layer, and the undercoating layer has a thickness of 0.5 to 4.8 μm.

Further, the present invention provides a method for manufacturing the electrophotographic photoconductor of claim 1 comprising the steps of;

dispersing non-conductive titanium oxide particles and a polyamide resin into a mixed solvent of a lower alcohol selected from the group consisting of methanol, ethanol, isopropyl alcohol and n-propyl alcohol and an organic solvent selected from the group consisting of chloroform, 1,2-dichloroethane, dichloromethane, trichlene, carbon tetrachloride, dimethylformamide and 1,2-dichloropropane, applying the resulting mixture to a conductive support to form an undercoating layer, and forming a photoconductive layer on the undercoating layer.

BRIEF DESCRIPTION OF THE DRAWINGS

The present invention will be detailed in conjunction with the accompanying drawings in which.

$$0.5 \leqq B \leqq 0.2A-15$$

$$80 \leqq A \leqq 99$$

Figure 4:
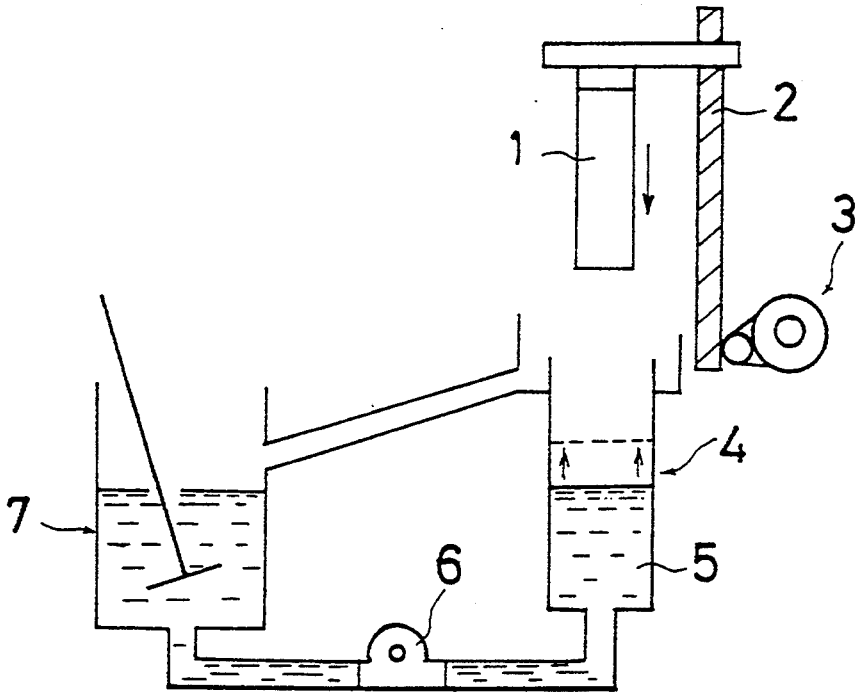

where A represents the content (wt %) of non-conductive titanium oxide particles in the undercoating layer and B represents the thickness (μm) of the undercoating layer, and FIG. 4 is a view showing a dip coating device used for manufacturing an electrophotographic photoconductor in accordance with the present invention.

DETAILED DESCRIPTION OF THE PREFERRED EMBODIMENT

An electrophotographic photoconductor in accordance with the present invention comprises an undercoating layer formed on a conductive support and a photosensitive layer formed on the undercoating layer. The photoconductor has a conspicuous feature that the mix ratio of non-conductive titanium oxide and polyamide resin and the thickness of the undercoating layer are specified.

As the conductive support, aluminum, aluminum alloy, copper, zinc, stainless steel, nickel, titanium, a polymer material such as polyethylene terephthalate, nylon, polystyrene, a hard paper laminated with metal foil such as aluminum or the like, a polymer material, a hard paper and the like impregnated with a conductive material, and material vapor deposited with aluminum, aluminum alloy, indium oxide, tin oxide and gold can be used. The configuration of the conductive support is not particularly limited, but may be take such shape as drum, sheet, seamless belt or the like.

The undercoating layer comprises non-conductive titanium oxide particles and polyamide resin. The non-conductive titanium oxide particles mean titanium oxide particles having a resistance of $10^5$ Ω·cm or more with respect to smashed particles of 100 kg/cm$^2$ or preferably $10^6$ Ω·cm or more. That is because the resistance smaller than the above may result in the reduction in the image tone or the generation of an image defect. The titanium oxide particles are classified into two types in the form of the crystals: anatase and rutile. The two types of titanium oxide can be used singly or in mixture.

In addition, various treatments can be applied to the surface of the titanium oxide particles of the present invention on condition that the resistance of the titanium oxide particles is not allowed to reduce. For example, the surface of the particles can be coated with an oxide film formed of $Al_2O_3$, $SiO_2$, ZnO or the like by using aluminum, silicon, zinc, nickel, antimony and chrome as a treating agent. Further, it is possible to improve the distribution to add water repellency with a coupling agent, surface treating agent such as stearic acid, organic cyclohexane or the like in accordance with the requirement. On the other hand, when surface treatment of the titanium oxide is applied so as to form a photoconductor wherein antimony is doped into tin oxide, the resistance of the titanium oxide particles reduce to $10^0$ to $10^4$ Ω·cm, which is not preferable. That is because the use of titanium oxide particles applied with conductive treatment like the above tin oxide conductor will result in the resistance of the undercoating layer to cease to function as a electric charge blocking layer. For example, a negatively charged multi-layer type electrophotographic photoconductor allows easy injection of carriers from the conductive support. The injected carriers easily pass through the electric charge generation layer to reach the surface of the photoconductor using an electric charge transport material with the result that the surface charge on the electric charge generation layer disappears or decreases thereby generating the reduction in the image tone and the image defect.

Further, the titanium oxide particles preferably have an average particle diameter of 1 μm or less, or more preferably 0.01 to 0.5 μm. The particle diameter larger than this diameter deteriorates the surface properties of the undercoating layer and reduces the effect of the coating the defect of the conductive support, thereby making it impossible to form homogeneously the photosensitive layer to be laminated on the undercoating layer, which exerts a unfavorable influence upon the sensitivity of the photoconductor to generate an image defect and an image tone irregularities. It means that the larger diameter is not preferable. On the other hand, the diameter smaller than this scope will result in the increase of viscosity of the application liquid for the undercoating layer to make it difficult to apply the undercoating layer thin admitting that the undercoating layer is free from surface finish problems. Besides, gellation is very likely to proceed to make it very difficult either to use or to conserve the application liquid for the undercoating layer, which is not preferable, either.

Methods for measuring the average particle diameter include a weight sedimentation method, and a light transmitting particle size distribution measuring method. Further, other known methods can be used for the purpose. The particle diameter can be directly measured in the microscopic observation.

Specific products of non-conductive titanium oxide sold on the market include ultramicroscopic titanium oxide "TTO-55 (A)" and "TTO-55 (B)" coated with $Al_2O_3$, ultramicroscopic titanium oxide surface treated with stearic acid "TTO-55 (C)", ultramicroscopic surface treated with $Al_2O_3$ and organo cyclohexane "TTO-55 (S)", highly pure titanium oxide "CR-EL", titanium oxide produced by sulfuric acid method such as "R-550", "R-580", "R-630", "R-670", "R-680", "R-780", "A-100", "A-220" and "W-10", titanium oxide produced by chlorine method such as "CR-50", "CR-58", "CR-60", "CR-60-2" and "CR-67" (manufactured by Ishihara Sangyo Kaisha, Ltd.), titanium oxide such as "R-60", "A-110", "A-150", a titanium oxide coated with a $Al_2O_3$ such as "SR-1", "R-GL", "R-5N", "R-5N-2", "R-52N", "RK-1", "A-SP", "R-GX" and "R-7E" coated with $SiO_2$,$Al_2O_3$, "R-650" coated with ZnO, $SiO_2$,$Al_2O_3$, "R-61N" coated with $ZrO_2$,$Al_2O_3$ (manufactured by Sakai Chemical Industry Co., Ltd.), "TR-700" surface treated with $SiO_2$,$Al_2O_3$, "TR-840" and "TR-500" surface treated with ZnO, $SiO_2$,$Al_2O_3$, a surface untreated titanium oxide such as "TA-100", "TA-200" and "TA-300" and "TA-400" surface treated with $Al_2O_3$ (manufactured by Fuji Titanium Co., Ltd.), but they are not limited to the above mentioned products.

In accordance with the present invention, it is preferable to set the content of non-conductive titanium oxide within the scope of 80 to 99 wt % in the undercoating layer, and it is important to select the thickness of the undercoating layer from the scope of 0.5 to 4.8 μm depending on the content of the non-conductive titanium oxide particles.

For example, when the content of the titanium oxide particles exhibits less than 80 wt %, a rise in the residual potential cannot be avoided with respect to an undercoating layer having a thickness of 1 μm or more or even less than 1 μm. The rise in the residual potential is conspicuous particularly at low temperature and low humidity. Consequently, reducing the thickness of the undercoating layer to 0.5 μm or less allows a reduced rise in the residual potential and accumulation of the residual potential in repetitive use. However, reducing the thickness of the undercoating layer to the above level will make ineffective the improvement in the charging properties and the prevention of the deterioration in sensitivity thereby making it impossible to form an undercoating layer having smooth surface that allows eliminating the defect of the conductive support and homogeneous application of the photosensitive layer.

In addition, the content of the titanium oxide particles of more than 99 wt %, though free from electrophotographic problems with respect to the undercoating layer having a thickness of more than 4.8 μm, will result in the reduction in the film strength and the adhesiveness to the conductive support leading to the breakage of the film, which will lead to an image defect to generate a durability problem.

Preferably, a specific undercoating layer has a thickness of 1.0 μm or less when the content of the non-conductive titanium oxide particles is 80 wt %, the undercoating layer has a thickness of 2.0 μm or less when the content of the non-conductive titanium oxide particles is 85 wt %, the undercoating layer has a thickness of 3.0 μm or less when the content of the non-conductive titanium oxide particles is 90 wt %, the undercoating layer has a thickness of 4.0 μm or less when the content of the non-conductive titanium oxide particles is 95 wt %, the undercoating layer has a thickness of 4.8 μm or less when the content of the non-conductive titanium oxide particles is 99 wt %.

Then, the photoconductor of the present invention has an undercoating layer which satisfies the following equation:

$$0.5 \leqq B \leqq 0.2A-15 \text{ and } 80 \leqq A \leqq 99$$

wherein A represent the content (wt %) of the non-conductive titanium oxide and B represents the thickness (μm) of the undercoating layer.

Figure 3:
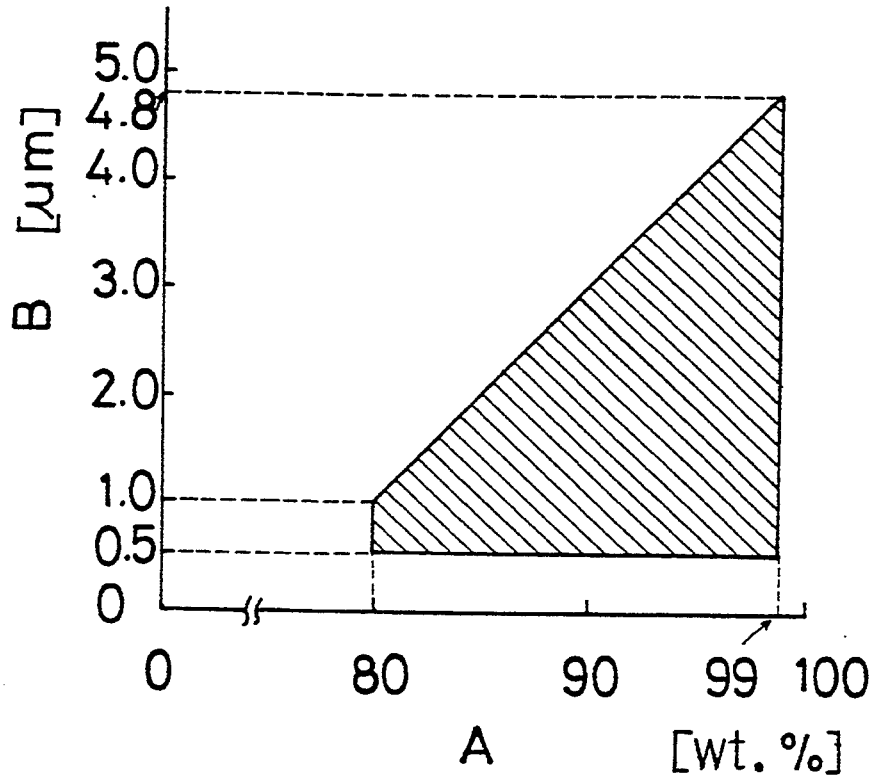
FIG. 3 is a shaded graph exhibiting a region that satisfies the following equations.

Referring to FIG. 3, the scope that satisfies the above equation is designated by slanted lines. An electrophotographic photoconductor having an undercoating layer that can be selected from a combination of the non-conductive titanium oxide particle having a content of A wt % that is present in a region designated by the scope of slanted lines and an undercoating layer having a thickness of B μm exhibits a very excellent electrophotographic properties. On the other hand, an electrophotographic photoconductor having a nonconductive titanium oxide in a region other than the scope surrounded by slanted lines and an undercoating layer having a thickness of B μm either allows a rise in the residual potential or no improvement in charging properties to result in the deterioration in the sensitivity in repetitive use. In addition, the deterioration in the film strength of the undercoating layer will result in exerting an unfavorable influence upon the electrophotographic properties such as the generation of an image defect, which does not allow the use thereof.

Polyamide resins used in the present invention are not limited to a particular kind if they are soluble in organic solvent and insoluble in particular organic solvent used for forming the photosensitive layer. They include alcohol soluble nylon resin, for example, so-called copolymer nylon formed through copolymerization of 6-nylon, 66-nylon, 610-nylon, 11-nylon, 12-nylon and the like and chemically modifying nylons such as N-alkoxymethyl modified nylon and N-alkoxyethyl modified nylon. Specific products include "CM4000", "CM8000" (manufactured by Toray Industries, Inc.), "F-30", "MF-30" and "EF-30T" (manufactured by Teikoku Chemical Industry Co., Ltd.)

In accordance with the present invention, the above non-conductive titanium oxide particles and polyamide resin are disparsed in an organic solvent to give an application liquid for forming an undercoating layer thereby forming an undercoating layer by applying the application liquid to the conductive support.

Organic solvents used for obtaining the application liquid for forming the undercoating layer is prefarably the mixture of a lower alcohol such as methanol, ethanol, isopropyl alcohol or n-propylalcohol, and an organic solvent such as chloroform, 1,2-dichloroethane, dichloromethane, trichlene, carbon tetrachloride, dimethylformamide or 1,2-dichloropropane, more prefarably, using at a voluntary ratio and a voluntary mixture of the above lower alcohol and chloroform, 1,2-dichloroethane, dichloromethane, carbon tetrachloride, dimethylformamide or 1,2-dichloropropane, because it leads to a constant boiling point which agrees the composition of the solvent and the composition of the vapor, whereby causing a homogeneous evaporation to eliminate the irregularities of the application.

Means for dispersing the application liquid for the undercoating layer includes a ball mill, a sand-mill, attritor, an oscillating mill and ultrasonic dispersing device. Means for application include such means as a dip coater, a blade coater, an applicator, rod coater, knife coater, casting and a spray.

Figure 1:
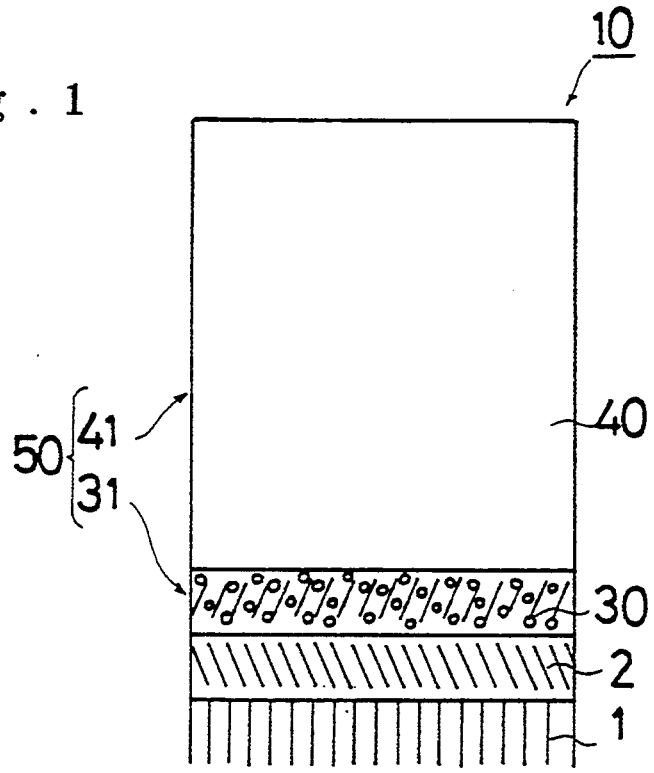
FIG. 1 is a sectional view of a multi-layer type electrophotographic photoconductor in accordance with the present invention.
Figure 2:
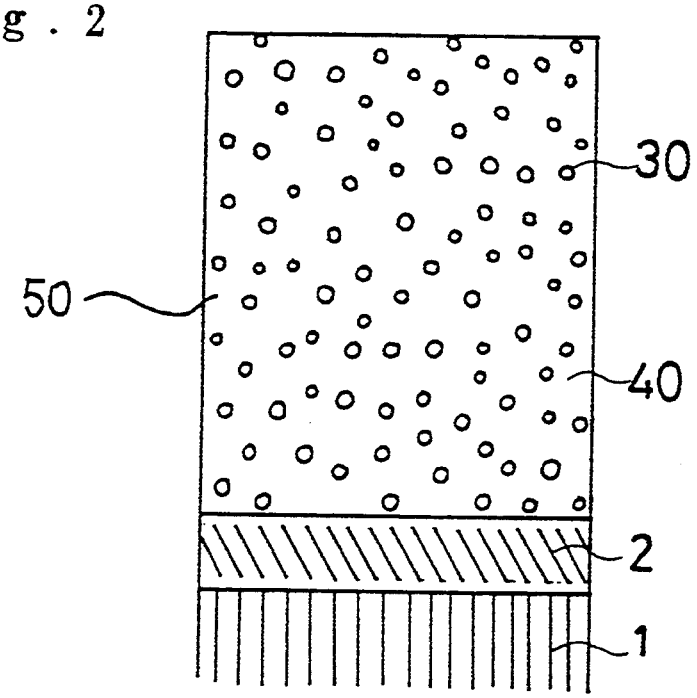
FIG. 2 is a sectional view of a single-layer type electrophotographic photoconductor in accordance with the present invention.

The electrophotographic photoconductor has a photosensitive layer formed on the undercoating layer. The photosensitive layer may comprise of a multi-layer type laminated structure or a single-layer structure. Preferably, the photosensitive layer may be of a negatively charged type for maintaining high sensitivity and high durability. FIG. 1 or FIG. 2 is an electrophotographic photoconductor having a multi-layer type laminated structure or a single-layer structure. Referring to FIG. 1 and FIG. 2, Reference Numeral 1 designates a conductive support, and 2 an undercoating layer.

In FIG. 1, the electrophotographic photoconductor 10 having a multi-layer type of the present invention is constituted by forming an electric charge transport layer 41 containing an electric charge transport material 40 on an electric charge generation layer 31 containing an electric generation material 30 as a photosensitive layer 50.

As the electric charge generation material used for an electric charge generation layer known are bis-azo compounds such as chlorodian blue, polycyclic quinone compounds such as dibromoanthanthrone, perylene compounds, quinacridone compounds, phthalocyanine compounds and azulenium salt compounds. One or more than one kinds thereof can be used together.

Methods for manufacturing the electric charge generation layer include one for directly forming compounds by vacuum deposition and one for forming a film by dispersing such compounds in a binding resin solution followed by applying the solution on the layer. Generally speaking, the latter method is preferable. The electric charge generation layer has a thickness of 0.05 to 5 μm, or more preferably 0.1 to 1 μm. Adopting the latter method allows using a method for mixing and dispersing the electric charge generation material into the binding-resin solution and a method for application similar to one used for the undercoating layer. In addition, binding resins used for binding resin solution include melamin resin, epoxy resin, silicon resin, polyurethan resin, acrylic resin, polycarbonate resin, phenoxy resin, vinyl chloride resin, vinyl acetate resin, styrene resin, and insulating resins such as copolymers containing more than one repetitive units of the above resins like vinyl chloride-vinyl acetate copolymer resin and acrylonitrile-styrene copolymer resins. However, the binding resins are not particularly limited to them, but all the resins generally used can be employed singly or by mixing two or more kinds.

In addition, as solvents for dissolving these resins can be used ketones such as acetone, methylethylketone, cyclohexane or the like, esters such as ethyl acetate, butyl acetate or the like, ethers like tetrahydrofuran, dioxane or the like, aromatic hydrocarbons such as benzene, toluene, xylene or the like, non-protone polar solvent such as N,N-dimethylformamide, N,N-dimethylacetoamide, dimethylsulfoxide or the like.

As the electric charge transport material can be used such materials as hydrazone compounds, pyrazoline compounds, triphenylamine compounds, triphenylmethane compounds, stylbene compounds, oxadiazole compounds. The electric charge transport layer can be manufactured by dissolving the electric charge transport material into the binding resin solution followed by applying the solution the same manner as applying undercoating layer. The electric charge transport layer has a thickness of 5 to 50 μm, or more preferably 10 to 40 μm.

The electrophotographic photoconductor shown in FIG. 2 has a photosensitive layer 50 of single-layer formed therein, the photosensitive layer 50 containing a charge generation material 30 and an electric charge transport material 40.

As the electric charge generation material 30, the electric charge transport material 40, the binding resin and the solvent for dissolving the resin, materials similar to the above mentioned ones can be used. As methods for mixing and dispersing these materials and methods for applying them, a method similar to one used for the undercoating layer can be used. The photosensitive layer has a thickness of 5 to 50 μm, or more preferably 10 to 40 μm.

Besides, the present invention allows using at least more than one kind of an electron receptive material or a dye in the undercoating layer in order to improve sensitive and stability in the repetitive use and reduce the residual potential.

Electron receptive materials include quinone compounds such as parabenzoquinone, chloranile, tetrachloro-1,2-benzoquinone, hydroquinone, 2,6-dimethylbenzoquinone, methyl-1,4-benzoquinone, α-naphthoquinone, β-naphthoquinone or the like, nitro compounds such as 2,4,7-trinitro-9-fluorenone, 1,3,6,8-tetranitrocarbazole, p-nitrobenzophenone, 2,4,5,7-tetranitro-9-fluorenone, 2-nitrofluorenone or the like, cyano compounds such as tetracyanoethylene, terephthalmarondinitrile, 7,7,8,8-tetracyanoquinodimethane, 4-(p-nitrobenzoyloxy)-2',2'-dicyanovinylbenzene, 4-(m-nitrobenzoyloxy)-2',2'-dicyanovinylbenzene, aldehydes such as 4-nitrobenzaldehyde or the like, anthraquinones such as anthraquinone, 1-nitroanthraquinone or the like. Among them, fluorenone compounds, quinone compounds and benzene derivatives having an electron attracting substituent like Cl, CN and $NO_2$ are particularly preferable.

As the dye, organic conductive compounds such as xanthene dye, thiazine dye, triphenylmethane dye, quinoline dye, copper phthalocyanine dye or the like can be used.

In addition, the undercoating layer in the electrophotographic photoconductor in accordance with the present invention can also contain an ultraviolet light absorber like benzoic acid, stylbene compounds and derivatives thereof, nitrogen-containing compounds such as triazole compounds, imidazole compounds, oxadiazole compounds, thiazole compounds and derivatives thereof, anti-oxidant and a levelling agent like silicone resin.

Further, a protective layer may be provided for protecting the surface of the photosensitive layer if required. The surface protective layer can be made of all the known thermoplastic resin, photo-setting or thermosetting resin within the scope free from a rise in the residual potential or a decrease in the sensitivity on condition that the protective layer has a certain degree of transparency. In addition, it may be possible to let the resin layer used in the photosensitive layer to contain the above ultra-violet light absorber, anti-oxidant, levelling agent, inorganic material such as metal oxides, organic metal compounds, electron receptive material. In addition, it may be possible to add processibility and plasticity by mixing a plasticizer such as dichloric ester, fatty ester, phosphate ester, phthalate ester and paraffin choride or the like.

The present invention will be detailed in conjunction with examples, but the invention is not limited to them.

EXAMPLE 1

To a mixed solvent of an azetropic composition comprising 28.7 parts by weight of methyl alcohol and 53.3 parts by weight of 1,2-dichloroethane were mixed 3.6 parts by weight of copolymer nylon resin (copolymer nylon resin of nylon 6/66/610/12, manufactured by Toray Industries, Inc.: CM8000) and 14.4 parts by weight of non-conductive titanium oxide particles coated with $Al_2O_3$ (manufactured by Ishihara Sangyo Co., Ltd.: TTO-55 (A), average particle diameter 0.03 μm, resistance of particle: $10^7\Omega$-cm). The mixture was scattered for 8 hours with a paint shaker to manufacture an application liquid for the undercoating layer. The application liquid thus manufactured was coated on an aluminum-made conductive support 1 to a thickness of 100 μm with a baker applicator, followed by drying the coated support with hot air for 10 minutes at a drying temperature of 110° C. to provide an undercoating layer 2 to a dried thickness of 1.0 μm.

In addition, 1.5 parts by weight of a bis-azo pigment (chlorodian blue) having the following chemical formula (I) and 1.5 parts by weight of a phenoxy resin (manufactured by Union Carbide: PKHH) were mixed to 97 parts by weight of 1,2-dimethoxyethane, followed by being scattered for 8 hours with the paint shaker to manufacture the application liquid for electric charge generation layer. This application liquid for the electric charge generation layer was applied on the undercoating layer 2 with the baker applicator. Then, the application liquid was dried with hot air for 10 minutes at a drying temperature of 90° C. to provide an electric charge generation layer 31 to a dried thickness of 0.8 μm.

(I)

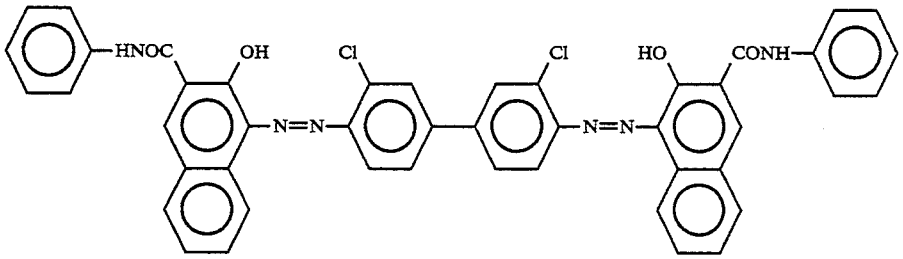

Further, 1 part by weight of a hydrazone compound of chemical formula (II), 0.5 part by weight of a polycarbonate resin (manufactured by Mitsubishi Gas Chemical Company, Ltd.: Z-200) and 0.5 part by weight of polyacrylate resin (manufactured by Unichika: U-100) were mixed to 8 parts by weight of dichloromethane followed by being stirred and dissolved with a magnetic staller to manufacture an application liquid for the electric charge transport layer. This application liquid for the electric charge transport layer was applied on the electric charge generation layer 31 with a baker applicator. The application liquid was dried with hot air for one hour at drying temperature of 80° C. to provide a electric charge transport layer 41 having a dried thickness of 20 μm, thereby manufacturing a function-distribution type electrophotographic photoconductor shown in FIG. 1.

(II)

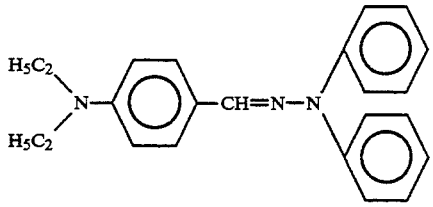

Thus the electrophotographic photoconductor was loaded on an actual device (manufactured by Sharp Kabushiki Kaisha: SF-8100) to measure a surface potential of the photoconductor at a developing section, for example, a surface potential ($V_O$) of the photoconductor in darkness except for the exposing process to see the charging capabilities, the surface potential ($V_R$)

after discharge and a surface potential ($V_L$) of the photoconductor at a blank portion when exposed to see sensitivity.

The initial properties and the properties after 10000 repetitive exposures of the electrophotographic photoconductor in accordance with the present invention were measured under the following conditions: low temperature/low humidity (5° C./30% RH, hereinafter abbreviated as "L/L"), normal temperature/normal humidity (25° C./60% RH, hereinafter abbreviated as "N/N") and high temperature/high humidity (35° C./85% RH, hereinafter abbreviated as "H/H"). Table 1 shows the results of the measurements.

EXAMPLES 2 TO 5

Examples 2 to 5 of electrophotographic photoconductors were manufactured in the same manner as Example 1 except that the rate of mixture of the copolymer nylon resin, the non-conductive titanium oxide coated with $Al_2O_3$ and the thickness of the undercoating layer in Example 1 was replaced with an undercoating layer having a combination shown in Table 1 to measure the electrophotographic properties in the same manner as in Example 1.

Table 1 shows the result of the measurements.

Comparative Example 1 to 7

Comparative examples 1 to 7 of electrophotographic photoconductors were manufactured in the same manner as Example 1 except that the rate of mixture of copolymer nylon resin and non-conductive titanium oxide particles coated with $Al_2O_3$ and the thickness of the undercoating layer was determined as shown in Table 1 to measure the electrophotographic properties in the same manner as in Example 1.

[TABLE 1]

| | content of $TiO_2$ (%) | tickness (μm) | environment | initial value (−V) $V_O$ | $V_R$ | $V_L$ | after 10000 cycle (−V) $V_O$ | $V_R$ | $V_L$ |
|---|---|---|---|---|---|---|---|---|---|
| Example 1 | 80 | 1.0 | L/L | 704 | 4 | 131 | 707 | 7 | 132 |
| | | | N/N | 705 | 3 | 132 | 706 | 5 | 134 |
| | | | H/H | 706 | 2 | 132 | 707 | 4 | 134 |
| Example 2 | 85 | 2.0 | L/L | 707 | 4 | 132 | 711 | 8 | 134 |
| | | | N/N | 708 | 3 | 133 | 710 | 5 | 135 |
| | | | H/H | 706 | 3 | 132 | 707 | 4 | 133 |
| Example 3 | 90 | 3.0 | L/L | 711 | 4 | 133 | 715 | 8 | 137 |
| | | | N/N | 712 | 3 | 134 | 715 | 6 | 136 |
| | | | H/H | 712 | 3 | 134 | 713 | 4 | 135 |
| Example 4 | 95 | 4.0 | L/L | 718 | 5 | 135 | 723 | 10 | 140 |
| | | | N/N | 719 | 4 | 134 | 722 | 7 | 137 |
| | | | H/H | 717 | 4 | 134 | 719 | 6 | 136 |
| Example 5 | 99 | 4.8 | L/L | 719 | 7 | 134 | 723 | 11 | 138 |
| | | | N/N | 723 | 5 | 135 | 727 | 9 | 139 |
| | | | H/H | 721 | 4 | 134 | 724 | 7 | 137 |
| Compar. 1 | 70 | 0.05 | L/L | 621 | 2 | 129 | 650 | 22 | 157 |
| | | | N/N | 620 | 2 | 128 | 652 | 25 | 160 |
| | | | H/H | 623 | 2 | 129 | 660 | 32 | 168 |
| Compar. 2 | 70 | 1.0 | L/L | 703 | 20 | 131 | 726 | 43 | 154 |
| | | | N/N | 704 | 12 | 132 | 725 | 34 | 153 |
| | | | H/H | 703 | 4 | 132 | 706 | 7 | 135 |
| Compar. 3 | 80 | 1.5 | L/L | 705 | 10 | 132 | 726 | 31 | 153 |
| | | | N/N | 706 | 4 | 132 | 713 | 11 | 139 |
| | | | H/H | 705 | 3 | 132 | 708 | 6 | 135 |
| Compar. 4 | 85 | 2.5 | L/L | 709 | 12 | 135 | 732 | 35 | 158 |
| | | | N/N | 710 | 6 | 134 | 718 | 14 | 142 |
| | | | H/H | 710 | 4 | 133 | 714 | 8 | 137 |
| Compar. 5 | 90 | 3.5 | L/L | 714 | 15 | 138 | 744 | 45 | 168 |
| | | | N/N | 715 | 7 | 135 | 735 | 27 | 155 |
| | | | H/H | 713 | 5 | 134 | 718 | 10 | 139 |
| Compar. 6 | 95 | 4.5 | L/L | 719 | 17 | 141 | 746 | 44 | 168 |
| | | | N/N | 719 | 9 | 139 | 741 | 31 | 161 |
| | | | H/H | 720 | 6 | 137 | 725 | 11 | 142 |

[TABLE 1]-continued

| | content of $TiO_2$ (%) | tickness (μm) | environment | initial value (−V) $V_O$ | $V_R$ | $V_L$ | after 10000 cycle (−V) $V_O$ | $V_R$ | $V_L$ |
|---|---|---|---|---|---|---|---|---|---|
| Compar. 7 | 99 | 5.5 | L/L | 724 | 22 | 144 | 754 | 52 | 174 |
| | | | N/N | 726 | 12 | 143 | 745 | 31 | 162 |
| | | | H/H | 725 | 10 | 142 | 731 | 16 | 148 |

EXAMPLES 6 TO 10

Examples 6 to 10 of electrophotographic photoconductors were manufactured in the same manner as Example 1 except that copolymer nylon resin used in the undercoating layer was replaced with N-methoxymethylated nylon resin (manufactured by Teikoku Chemical Industry Co., Ltd.: EF-30T) and that the rate of mixture of the nylon resin and the non-conductive titanium oxide particles coated with $Al_2O_3$ and the thickness of the undercoating layer was determined as shown in Table 2 to measure the electrophotographic properties in the same manner as in Example 1.

Table 2 shows the result of the measurements.

Comparative Examples 8 to 14

Comparative examples 8 to 14 of electrophotographic photoconductors were manufactured in the same manner as Example 1 except that the rate of mixture of N-methoxymethylated nylon used in the undercoating layer in Example 6 and non-conductive titanium oxide particles coated with $Al_2O_3$ as well as the thickness of the undercoating layer were determined as shown in Table 2 to measure the electrophotographic properties in the same manner as in Example 1.

Table 2 shows the result of the measurements.

[TABLE 2]

| | content of $TiO_2$ (%) | tickness (μm) | environment | initial value (−V) $V_O$ | $V_R$ | $V_L$ | after 10000 cycle (−V) $V_O$ | $V_R$ | $V_L$ |
|---|---|---|---|---|---|---|---|---|---|
| Example 6 | 80 | 1.0 | L/L | 706 | 4 | 130 | 708 | 6 | 132 |
| | | | N/N | 707 | 3 | 131 | 708 | 4 | 132 |
| | | | H/H | 706 | 3 | 130 | 706 | 3 | 130 |
| Example 7 | 85 | 2.0 | L/L | 710 | 4 | 132 | 712 | 6 | 134 |
| | | | N/N | 712 | 3 | 131 | 713 | 4 | 132 |
| | | | H/H | 711 | 3 | 131 | 712 | 4 | 132 |
| Example 8 | 90 | 3.0 | L/L | 714 | 4 | 133 | 717 | 7 | 136 |
| | | | N/N | 712 | 3 | 132 | 714 | 5 | 134 |
| | | | H/H | 713 | 3 | 133 | 714 | 4 | 134 |
| Example 9 | 95 | 4.0 | L/L | 720 | 5 | 135 | 723 | 8 | 138 |
| | | | N/N | 723 | 4 | 133 | 725 | 6 | 135 |
| | | | H/H | 721 | 3 | 134 | 727 | 5 | 134 |
| Example 10 | 99 | 4.8 | L/L | 723 | 6 | 135 | 725 | 9 | 138 |
| | | | N/N | 725 | 4 | 134 | 728 | 7 | 137 |
| | | | H/H | 725 | 4 | 134 | 727 | 6 | 136 |
| Compar. 8 | 70 | 0.05 | L/L | 612 | 2 | 129 | 651 | 23 | 158 |
| | | | N/N | 611 | 2 | 129 | 650 | 25 | 165 |
| | | | H/H | 613 | 2 | 128 | 658 | 34 | 172 |
| Compar. 9 | 70 | 1.0 | L/L | 711 | 20 | 133 | 732 | 41 | 154 |
| | | | N/N | 709 | 10 | 130 | 729 | 30 | 150 |
| | | | H/H | 708 | 4 | 131 | 712 | 8 | 135 |
| Compar. 10 | 80 | 1.5 | L/L | 713 | 14 | 134 | 733 | 34 | 154 |
| | | | N/N | 710 | 6 | 132 | 719 | 15 | 141 |
| | | | H/H | 709 | 4 | 131 | 712 | 7 | 134 |
| Compar. 11 | 85 | 2.5 | L/L | 719 | 17 | 135 | 741 | 39 | 157 |
| | | | N/N | 714 | 8 | 133 | 723 | 17 | 142 |
| | | | H/H | 713 | 5 | 132 | 718 | 10 | 137 |
| Compar. 12 | 90 | 3.5 | L/L | 719 | 18 | 135 | 748 | 47 | 164 |
| | | | N/N | 717 | 10 | 134 | 738 | 31 | 155 |
| | | | H/H | 716 | 6 | 132 | 722 | 12 | 138 |
| Compar. | 95 | 4.5 | L/L | 725 | 19 | 137 | 756 | 50 | 168 |

[TABLE 2]-continued

| | content of $TiO_2$ (%) | thickness (μm) | environment | initial value (−V) $V_O$ | $V_R$ | $V_L$ | after 10000 cycle (−V) $V_O$ | $V_R$ | $V_L$ |
|---|---|---|---|---|---|---|---|---|---|
| 13 | | | N/N | 724 | 11 | 134 | 747 | 34 | 157 |
| | | | H/H | 722 | 7 | 134 | 728 | 13 | 140 |
| Compar. 14 | 99 | 5.5 | L/L | 728 | 23 | 142 | 759 | 54 | 173 |
| | | | N/N | 729 | 13 | 138 | 749 | 33 | 158 |
| | | | H/H | 727 | 10 | 137 | 733 | 16 | 143 |

EXAMPLES 11 TO 15

Examples 11 to 15 of electrophotographic photoconductors were manufactured in the same manner as in Example 1 except that non-conductive titanium oxide particles coated with $Al_2O_3$ was replaced with non-conductive titanium oxide uncoated with titanium oxide particles (Fuji Chitan Co., Ltd.: TA-300, average diameter 0.35 μm, resistance of particle: $10^6\Omega\cdot$cm), the rate of mixture of copolymer nylon resin and the thickness of the undercoating layer were determined as shown in Table 3 in the same manner as in Example 1 to measure the electrophotographic properties in the same manner in Table 1.

Table 3 shows the result of the measurements.

Comparative Examples 15 to 21

Comparative examples 15 to 21 of electrophotographic photoconductors were manufactured in the same manner as Example 1 except that the rate of mixture of non-conductive titanium oxide particles uncoated with $Al_2O_3$ used in the undercoating layer in Example 11 and copolymer nylon resin as well as the thickness of the undercoating layer were determined as shown in Table 3 to measure the electrophotographic properties in the same manner as Example 1. Table 3 shows the result of the measurements.

[TABLE 3]

| | content of $TiO_2$ (%) | thickness (μm) | environment | initial value (−V) $V_O$ | $V_R$ | $V_L$ | after 10000 cycle (−V) $V_O$ | $V_R$ | $V_L$ |
|---|---|---|---|---|---|---|---|---|---|
| Example 11 | 80 | 1.0 | L/L | 703 | 4 | 132 | 705 | 6 | 134 |
| | | | N/N | 705 | 3 | 133 | 707 | 5 | 135 |
| | | | H/H | 705 | 2 | 132 | 707 | 4 | 134 |
| Example 12 | 85 | 2.0 | L/L | 706 | 4 | 131 | 709 | 7 | 134 |
| | | | N/N | 708 | 3 | 131 | 710 | 5 | 133 |
| | | | H/H | 707 | 2 | 132 | 708 | 3 | 133 |
| Example 13 | 90 | 3.0 | L/L | 709 | 4 | 133 | 712 | 7 | 136 |
| | | | N/N | 711 | 3 | 133 | 713 | 5 | 135 |
| | | | H/H | 710 | 3 | 132 | 712 | 5 | 134 |
| Example 14 | 95 | 4.0 | L/L | 719 | 5 | 134 | 723 | 9 | 138 |
| | | | N/N | 720 | 4 | 135 | 723 | 7 | 138 |
| | | | H/H | 718 | 3 | 134 | 721 | 6 | 137 |
| Example 15 | 99 | 4.8 | L/L | 721 | 6 | 135 | 725 | 10 | 139 |
| | | | N/N | 722 | 5 | 134 | 725 | 8 | 137 |
| | | | H/H | 720 | 5 | 134 | 723 | 8 | 137 |
| Compar. 15 | 70 | 0.05 | L/L | 619 | 2 | 129 | 651 | 23 | 158 |
| | | | N/N | 620 | 3 | 128 | 653 | 24 | 159 |
| | | | H/H | 618 | 2 | 128 | 662 | 34 | 170 |
| Compar. 16 | 70 | 1.0 | L/L | 704 | 19 | 132 | 725 | 40 | 153 |
| | | | N/N | 706 | 10 | 131 | 727 | 31 | 152 |
| | | | H/H | 705 | 4 | 132 | 708 | 7 | 135 |
| Compar. 17 | 80 | 1.5 | L/L | 702 | 10 | 132 | 724 | 32 | 154 |
| | | | N/N | 706 | 4 | 133 | 714 | 12 | 141 |
| | | | H/H | 704 | 4 | 132 | 708 | 8 | 136 |
| Compar. 18 | 85 | 2.5 | L/L | 712 | 13 | 136 | 735 | 36 | 159 |
| | | | N/N | 709 | 7 | 134 | 718 | 16 | 143 |
| | | | H/H | 708 | 4 | 133 | 711 | 7 | 136 |
| Compar. | 90 | 3.5 | L/L | 716 | 16 | 139 | 748 | 48 | 171 |

[TABLE 3]-continued

| | content of $TiO_2$ (%) | thickness (μm) | environment | initial value (−V) $V_O$ | $V_R$ | $V_L$ | after 10000 cycle (−V) $V_O$ | $V_R$ | $V_L$ |
|---|---|---|---|---|---|---|---|---|---|
| 19 | | | N/N | 715 | 9 | 135 | 731 | 25 | 151 |
| | | | H/H | 714 | 6 | 135 | 720 | 12 | 141 |
| Compar. 20 | 95 | 4.5 | L/L | 721 | 17 | 140 | 746 | 42 | 165 |
| | | | N/N | 720 | 10 | 140 | 743 | 33 | 163 |
| | | | H/H | 719 | 6 | 138 | 725 | 12 | 144 |
| Compar. 21 | 99 | 5.5 | L/L | 721 | 21 | 142 | 750 | 50 | 171 |
| | | | N/N | 717 | 11 | 143 | 737 | 31 | 163 |
| | | | H/H | 718 | 18 | 141 | 724 | 14 | 147 |

EXAMPLE 16 TO 20

Examples 16 to 20 of electrophotographic photoconductors were manufactured in Example 1 except that the rate of mixture of copolymer nylon resin and non-conductive titanium oxide perticle coated with $Al_2O_3$ used in the undercoating layer in Example 1 was replaced with N-methoxymethylated nylon resin (manufactured by Teikoku Chemical Industry Co., Ltd.: EF-30T) and non-conductive titanium oxide particles uncoated with $Al_2O_3$ (manufactured by Fuji Chitan: TA-300, average diameter 0.35 μm and resistance of particle: $10^6\Omega\cdot$cm), the mixture rate thereof and the thickness of the undercoating layer were determined as shown in Table 4 to measure the electrophotographic photoconductors in the same manner as Example 1.

Table 4 shows the result of the measurements.

Comparative Examples 21 Through 28

Comparative examples 21 to 28 of electrophotographic photoconductors were manufactured in the same manner as Example 1 except that the rate of mixture of N-methoxymethylated nylon resin used in the undercoating layer in Example 16 and non-conductive titanium oxide particles uncoated with $Al_2O_3$ and the thickness of the undercoating layer were determined as shown in Table 4 to measure the electrophotographic properties in the same manner as Example 1.

Table 4 shows the result of the measurements.

[TABLE 4]

| | content of $TiO_2$ (%) | thickness (μm) | environment | initial value (−V) $V_O$ | $V_R$ | $V_L$ | after 10000 cycle (−V) $V_O$ | $V_R$ | $V_L$ |
|---|---|---|---|---|---|---|---|---|---|
| Example 16 | 80 | 1.0 | L/L | 707 | 4 | 131 | 709 | 6 | 132 |
| | | | N/N | 706 | 3 | 130 | 707 | 4 | 131 |
| | | | H/H | 706 | 2 | 130 | 706 | 2 | 130 |
| Example 17 | 85 | 2.0 | L/L | 711 | 4 | 133 | 703 | 6 | 135 |
| | | | N/N | 709 | 3 | 132 | 710 | 4 | 133 |
| | | | H/H | 712 | 3 | 131 | 713 | 4 | 132 |
| Example 18 | 90 | 3.0 | L/L | 715 | 4 | 132 | 718 | 7 | 135 |
| | | | N/N | 714 | 3 | 133 | 715 | 4 | 134 |
| | | | H/H | 713 | 3 | 132 | 714 | 4 | 133 |
| Example 19 | 95 | 4.0 | L/L | 721 | 5 | 132 | 724 | 8 | 135 |
| | | | N/N | 719 | 4 | 132 | 721 | 6 | 134 |
| | | | H/H | 723 | 3 | 133 | 724 | 4 | 134 |
| Example 20 | 99 | 4.8 | L/L | 725 | 6 | 135 | 728 | 9 | 138 |
| | | | N/N | 723 | 5 | 134 | 726 | 8 | 137 |
| | | | H/H | 723 | 4 | 133 | 725 | 6 | 136 |
| Compar. 22 | 70 | 0.05 | L/L | 610 | 3 | 129 | 649 | 24 | 157 |
| | | | N/N | 611 | 2 | 128 | 651 | 27 | 167 |
| | | | H/H | 609 | 2 | 128 | 660 | 33 | 175 |
| Compar. 23 | 70 | 1.0 | L/L | 712 | 16 | 133 | 733 | 37 | 154 |
| | | | N/N | 710 | 11 | 130 | 731 | 32 | 152 |
| | | | H/H | 708 | 5 | 130 | 712 | 9 | 134 |
| Compar. | 80 | 1.5 | L/L | 712 | 18 | 134 | 734 | 40 | 156 |

[TABLE 4]-continued

| | content of $TiO_2$ (%) | tickness (μm) | environment | initial value (−V) $V_O$ | $V_R$ | $V_L$ | after 10000 cycle (−V) $V_O$ | $V_R$ | $V_L$ |
|---|---|---|---|---|---|---|---|---|---|
| 24 | | | N/N | 709 | 12 | 131 | 720 | 23 | 142 |
| | | | H/H | 711 | 6 | 131 | 715 | 10 | 135 |
| Compar. | 85 | 2.5 | L/L | 721 | 19 | 136 | 744 | 42 | 159 |
| 25 | | | N/N | 716 | 13 | 134 | 726 | 23 | 144 |
| | | | H/H | 715 | 7 | 132 | 721 | 13 | 138 |
| Compar. | 90 | 3.5 | L/L | 722 | 20 | 136 | 760 | 48 | 164 |
| 26 | | | N/N | 718 | 13 | 135 | 737 | 32 | 154 |
| | | | H/H | 717 | 8 | 132 | 723 | 14 | 138 |
| Compar. | 95 | 4.5 | L/L | 726 | 22 | 138 | 755 | 51 | 167 |
| 27 | | | N/N | 725 | 14 | 135 | 743 | 32 | 153 |
| | | | H/H | 720 | 9 | 134 | 724 | 13 | 138 |
| Compar. | 99 | 5.5 | L/L | 728 | 23 | 142 | 758 | 53 | 173 |
| 28 | | | N/N | 727 | 15 | 139 | 754 | 32 | 156 |
| | | | H/H | 725 | 11 | 137 | 729 | 15 | 141 |

Comparative Example 29

Comparative example 29 of electrophotographic photoconductor was manufactured in the same manner as Example 1 except that 18 parts by weight of copolymer nylon resin (manufactured by Toray Industries, Inc.: CM8000) was used in the undercoating layer and the non-conductive titanium oxide particle was removed to measure the electrophotographic properties of Example 1.

Table 5 shows the result of the measurements.

Comparative Example 30

Comparative example 30 of electrophotographic photoconductor was manufactured as Example 1 except that 18 parts by weight of N-methoxymethylated nylon resin (manufactured by Teikoku Chemical Industry Co., Ltd.: EF-30T) was used in the undercoating layer and the non-conductive titanium oxide particle was removed to measure the electrophotographic properties in the same manner as Example 1.

Table 5 shows the result of the measurements.

Comparative Example 31

Comparative example 31 of electrophotographic photoconductor was measured as Example 1 except that the non-conductive titanium oxide particles used in the undercoating layer in Example 1 was replaced with conductive titanium oxide particles (manufactured by Ishihara Sangyo Kaisha, Ltd.: 500 W, average particle diameter 0.3 μm, resistance of particle: 3 Ω·cm) to measure the electrophotographic properties in the same manner as Example 1.

Table 5 shows the result of the measurements.

Comparative Example 32

Comparative Example 32 of electrophotographic photoconductor was manufactured in the same manner as Example 1 except that the non-conductive titanium oxide particles used in the undercoating layer in Example 6 was replaced by the conductive titanium oxide particles (manufactured by Ishihara Sangyo Kaisha, Ltd.: 500 W, average particle diameter 0.3 μm, resistance of particle: 3 Ω·cm) to measure the electrophotographic properties in the same manner as Example 1.

Table 5 shows the result of the measurements.

Comparative Example 33

Comparative example 33 of the electrophotographic photoconductor was manufactured in the same manner as Example 1 except that copolymer nylon resin used in the undercoating layer in Example 1 was replaced with polyester resin (manufactured by Toyobo Co., Ltd.: Byron 200) and 82 parts by weight of 1,2-dichloroethane was used as a solvent to measure the electrophotographic properties in the same manner as Example 1.

Table 5 shows the result of the measurements.

[TABLE 5]

| | content of $TiO_2$ (%) | tickness (μm) | environment | initial value (−V) $V_O$ | $V_R$ | $V_L$ | after 10000 cycle (−V) $V_O$ | $V_R$ | $V_L$ |
|---|---|---|---|---|---|---|---|---|---|
| Compar. | 0 | 1.0 | L/L | 713 | 22 | 137 | 904 | 246 | 365 |
| 29 | | | N/N | 716 | 19 | 135 | 751 | 110 | 230 |
| | | | H/H | 715 | 16 | 134 | 743 | 78 | 207 |
| Compar. | 0 | 1.0 | L/L | 715 | 20 | 139 | 913 | 241 | 375 |
| 30 | | | N/N | 714 | 19 | 137 | 750 | 102 | 219 |
| | | | H/H | 713 | 17 | 136 | 741 | 72 | 199 |
| Compar. | 80 | 1.0 | L/L | 645 | 8 | 112 | 213 | 2 | 34 |
| 31 | | | N/N | 643 | 6 | 113 | 211 | 1 | 30 |
| | | | H/H | 613 | 6 | 110 | 210 | 1 | 32 |
| Compar. | 80 | 1.0 | L/L | 615 | 8 | 111 | 215 | 2 | 35 |
| 32 | | | N/N | 617 | 8 | 112 | 216 | 1 | 34 |
| | | | H/H | 614 | 7 | 110 | 212 | 1 | 32 |
| Compar. | 80 | 1.0 | L/L | 618 | 6 | 133 | 521 | 11 | 127 |
| 33 | | | N/N | 621 | 4 | 134 | 524 | 8 | 125 |
| | | | H/H | 624 | 3 | 131 | 513 | 7 | 120 |

EXAMPLE 21

The electrophotographic photoconductor actually manufactured in Example 9 was loaded on an actual device (manufactured by Sharp Kabushiki Kaisha; SF-8100) to perform image evaluation repetitively 10000 times to prove that no reduction in the image tone and no overlapping of images were generated under any environmental conditions of L/L, N/N and H/H, thus generating a favorable image quality without any defect (such as black dots and white dots) even in 10000 times repetitive use.

EXAMPLE 22

The electrophotographic photoconductor manufactured in Example 19 was subjected to an image evaluation in the same manner as Example 21 to provide a favorable result without image defect or reduction in the image tone or overlapping of images.

Comparative Example 34

Comparative Example 34 of the electrophotographic photoconductor was manufactured in the same manner as Example 19 except that the non-conductive titanium oxide particles having an average diameter of 0.35 μm used in the undercoating layer in Example 19 was replaced by surface untreated non-conductive titanium oxide particles having an average particle diameter of 1.48 μm (manufactured by Fuji Chitan: TP-2, resistance of particle: $10^6$Ω·cm) to perform the image evaluation in the same manner as Example 21.

The surface of the undercoating layer provides a rough and heterogeneous film with the result that the tone irregularities of the electric charge generation material was generated when a photoconductor was manufactured with it. Image tone irregularities and image defects (such as black dots and white dots) were observed in the initial image corresponding to the irregularities of the undercoating layer and the electric charge generation material. Further, after 10000 repetitive uses of the photoconductor, partial overlapping of images was generated, which was particularly conspicuous in the environmental conditions of L/L.

EXAMPLE 23

A single-layer electrophotographic photoconductor shown in FIG. 2 was manufactured by adding to 95 parts by weight of dichloromethane on the undercoating layer manufactured in Example 1, 1 part by weight of bis-azo pigment having a chemical formula (I) used in Example 1, 5 parts by weight of hydrazone compounds, 2.5 parts by weight of polycarbonate resin (manufactured by Mitsubishi Gas Chemical Co., Ltd.: Z-200) and 2.5 . parts by weight of polyarylate resin (manufactured by Unichika: U-100), dispersing the above compounds for 10 hours in the ball mill to prepare the application liquid, coating the application liquid with a baker applicator, and providing a photosensitive layer 50 having a dried thickness of 10 μm through heating and drying for 1 hours at 80° C.

The photoconductor thus manufactured was subjected to an image evaluation to provide a favorable result without image defects, reduction in image tone and overlapping of images.

In this way, the present invention provides the undercoating layer comprising the photoconductive titanium oxide particles and polyamide resin between the photoconductive support and the photosensitive layer to improve the chargeability of the photoconductor and the residual potential and to accumulate only a small quantity of residual potential in repetitive use, thereby providing a favorable image properties excellent in repetitive stability and environmental properties small in deterioration in photosensitivity.

EXAMPLE 24

To a mixture of 28.7 parts by weight of methyl alcohol and 53.3 parts by weight of 1,2-dichloroethane were mixed 0.9 parts by weight of methoxymethylated nylon resin (Teiko-ku Chemical Industry, Co., Ltd.: tredine EF-30T) and 17.1 parts by weight of non-conductive titanium oxide (Ishihara Sangyo Co., Ltd.: TTO-55A) to be scattered for 8 hours with a paint shaker, thereby providing an application liquid for the undercoating layer.

Then, as shown in FIG. 1, on an aluminum-made photoconductive support 1 having a thickness of 100 μm, an application liquid for the undercoating layer was applied with the baker applicator to be dried with hot air for 10 minutes at 110° C. to form an undercoating layer 2 having a thickness of 1.5 μm.

Subsequently, a mixture of 1.5 parts by weight of chlorodianblue pigment (having the above Chemical Formula (I)) and 1.5 parts by weight of butyral resin (manufactured by Union Carbide Co.,: XYSG) are scattered to 97 parts by weight of methylisobutylketone for 8 hours with paint shaker to provide an application liquid for electric charge generation layer. This application liquid for the electric charge generation layer was applied to the undercoating layer 2 with a baker applicator, dried with hot air for 10 minutes at a drying temperature of 90° C. to form an electric charge generation layer 30 to a dried thickness of 0.8 μm.

Further, a mixture of 1 part by weight of hydrazone compound (having the above Chemical Formula (II): 4-diethylaminobenzaldehyde-N,N-diphenylhydrazone) and 1 part by weight of polycarbonate resin (Mitsubishi Gas Chemical Co., Upiron) was stirred and dissolved in 8 parts by weight of dichloromethane with a magnetic stirrer to provide an application liquid for an electric charge transport layer.

Following that, the application liquid for the electric charge transport layer was applied to the electric charge generation layer with a baker applicator, dried with hot air for 1 hour at a drying temperature of 80° C. to form an electric charge transport layer 40 to a dried thickness of 20 μm to manufacture an electrophotographic photoconductor.

The electrophotographic photoconductor thus manufactured was loaded on an actual device (manufactured by Sharp Kabushiki Kaisha: SF-8100) to measure the surface potential of the photoconductor at the developing section, for example, the surface potential ($V_O$) of the photoconductor in the darkness except for the exposing process to see the charging capabilities, and the surface potential ($V_R$) after discharge and the surface potential ($V_L$) of the photoconductor at the blank section when exposed to see sensitivity.

The initial properties of the electrophotographic photoconductor in accordance with the present invention and properties of the same after 10000 repetitive uses were measured in the environmental conditions: low temperature/low humidity (5° C./30% RH), normal temperature/normal humidity (25° C./60% RH), and high temperature/high humidity (35° C./85% RH). Table 6 shows the result of the measurements.

[TABLE 6]

| environment | initial value (V) | | | after 10000 cycle (V) | | |
|---|---|---|---|---|---|---|
| | $V_O$ | $V_R$ | $V_L$ | $V_O$ | $V_R$ | $V_L$ |
| L/L | −701 | −9 | −132 | −704 | −12 | −135 |
| N/N | −700 | −7 | −136 | −702 | −9 | −138 |
| H/H | −704 | −5 | −135 | −705 | −7 | −137 |

EXAMPLE 25

Example 25 of the electrophotographic photoconductor was manufactured in the same manner as Example 24 except that the rate of mixture of methoxymethylated nylon resin and non-conductive titanium oxide used in the undercoating layer 2 in Example 24 was set to 1.8 parts by weight of methoxymethylated nylon resin vs 16.2 parts by weight of non-conductive titanium oxide to measure the electrophotographic properties in the same manner as Example 24. Table 7 shows the result of the measurements.

[TABLE 7

| environment | initial value (V) | | | after 10000 cycle (V) | | |
|---|---|---|---|---|---|---|
| | $V_O$ | $V_R$ | $V_L$ | $V_O$ | $V_R$ | $V_L$ |
| L/L | −702 | −12 | −136 | −706 | −18 | −140 |
| N/N | −699 | −9 | −135 | −703 | −13 | −139 |
| H/H | −705 | −8 | −133 | −707 | −11 | −135 |

EXAMPLE 26

Example 26 of the electrophotographic photoconductor was manufactured in the same manner as Example 24 except that the rate of mixture of methoxymethylated nylon resin and non-conductive titanium oxide used in the undercoating layer 2 in Example 24 was set to 0.18 part by weight of methoxymethylated nylon resin vs 17.82 parts by weight of non-conductive titanium oxide to measure the electrophotographic properties of the photoconductor. Table 8 shows the result of the measurements.

[TABLE 8]

| environment | initial value (V) | | | after 10000 cycle (V) | | |
|---|---|---|---|---|---|---|
| | $V_O$ | $V_R$ | $V_L$ | $V_O$ | $V_R$ | $V_L$ |
| L/L | −703 | −7 | −133 | −705 | −10 | −137 |
| N/N | −700 | −5 | −135 | −703 | −7 | −137 |
| H/H | −699 | −5 | −130 | −700 | −6 | −134 |

Comparative Example 35

Comparative Example 35 of the electrophotographic photoconductor was manufactured in the same manner as Example 24 except that the rate of mixture of methoxymethylated nylon resin used in the undercoating layer 2 in Example 24 was set to 18 parts by weight and the non-conductive titanium oxide was removed to measure the electrophotographic properties in the same manner as Example 24. Table 9 shows the result of the measurements.

[TABLE 9]

| environment | initial value (V) | | | after 10000 cycle (V) | | |
|---|---|---|---|---|---|---|
| | $V_O$ | $V_R$ | $V_L$ | $V_O$ | $V_R$ | $V_L$ |
| L/L | −708 | −20 | −140 | −746 | −48 | −175 |
| N/N | −701 | −16 | −138 | −733 | −42 | −159 |
| H/H | −697 | −5 | −135 | −727 | −27 | −159 |

Comparative Example 36

Comparative Example 36 of the electrophotographic photoconductor was manufactured in the same manner as Example 24 except that the rate of mixture of methoxymethylated nylon resin and non-conductive titanium oxide used in the undercoating layer 2 in Example 24 was set to 3.6 parts by weight of methoxymethylated nylon resin vs 14.4 parts by weight of non-conductive titanium oxide to measure the electrophotographic photoconductor in the same manner as Example 24. Table 10 shows the result of the measurements.

[TABLE 10]

| environment | initial value (V) | | | after 10000 cycle (V) | | |
|---|---|---|---|---|---|---|
| | $V_O$ | $V_R$ | $V_L$ | $V_O$ | $V_R$ | $V_L$ |
| L/L | −706 | −18 | −138 | −735 | −41 | −166 |
| N/N | −700 | −13 | −134 | −729 | −31 | −154 |
| H/H | −698 | −12 | −134 | −715 | −26 | −150 |

Comparative Example 37

Comparative Example 37 of the electrophotographic photoconductor was manufactured in the same manner as Example 24 except that non-conductive titanium oxide used in the undercoating layer 2 in Example 24 was replaced by conductive titanium oxide (manufactured by Ishihara Sangyo Co. Ltd.: 500W) to measure the electrophotographic properties in the same manner as Example 24. Table 11 shows the result of the measurements.

[TABLE 11]

| environment | initial value (V) | | | after 10000 cycle (V) | | |
|---|---|---|---|---|---|---|
| | $V_O$ | $V_R$ | $V_L$ | $V_O$ | $V_R$ | $V_L$ |
| L/L | −650 | −4 | −119 | −579 | −3 | −109 |
| N/N | −655 | −3 | −118 | −593 | −3 | −111 |

[TABLE 11]-continued

| environment | initial value (V) | | | after 10000 cycle (V) | | |
|---|---|---|---|---|---|---|
| | $V_O$ | $V_R$ | $V_L$ | $V_O$ | $V_R$ | $V_L$ |
| H/H | −654 | −2 | −117 | −599 | −2 | −108 |

Comparative Example 38

Comparative Example 38 of the electrophotographic photoconductor was manufactured in the same manner as Example 24 except that methoxymethylated nylon resin used in the undercoating layer 2 in Example 24 was replaced by copolymer nylon resin (manufactured by Toray Industries, Inc. : CM8000) to measure the electrophotographic properties in the same manner as Example 24. Table 12 shows the result of the measurements.

[TABLE 12]

| environment | initial value (V) | | | after 10000 cycle (V) | | |
|---|---|---|---|---|---|---|
| | $V_O$ | $V_R$ | $V_L$ | $V_O$ | $V_R$ | $V_L$ |
| L/L | −710 | −22 | −142 | −670 | −76 | −205 |
| N/N | −705 | −19 | −135 | −777 | −59 | −197 |
| H/H | −696 | −12 | −134 | −763 | −58 | −170 |

Tables 6 to 8 clearly show that the electrophotographic photoconductor according to the present invention is excellent in stability in any environmental conditions. On the other hand, comparative examples of the electrophotographic photoconductor shown in Table 9 to 12 exhibited a remarkable deterioration in the surface potential ($V_L$) of the photoconductor at the blank portion when exposed and a rise in the surface potential ($V_O$) and the surface potential ($V_R$) after discharge by repetitive use, thereby failing in providing a favorable electrophotographic photoconductor.

EXAMPLE 27

To a mixed solvent of an azetropic composition comprising 28.7 parts by weight of methyl alcohol and 53.3 parts by weight of 1,2-dichloroethane was scattered a mixture of 0.9 part by weight of methoxymethylated nylon resin (Teikoku Chemical Industry Co., Ltd.: tredine EF-30T) and 17.1 parts by weight of non-conductive titanium oxide (Ishihara Sangyo, Co., Ltd.: TTO-55A) for 8 hours with a paint shaker to prepare an application liquid for the undercoating layer. The application liquid thus prepared was coated on the aluminum-made drum-like support having a size of 1 mmt×80 mmϕ×340 mm with a dip coating device shown in FIG. 4, dried with hot air at a drying temperature of 110° C. for 10 minutes to provide an undercoating layer to a dried thickness of 1.5 μm. On the undercoating layer, a mixture of 97 parts by weight of methylisobutylketone, 1.5 parts by weight of bis-azo pigment (chlorodian blue: having the above chemical formula (I)) and butyral resin (manufactured by Union Carbide) was scattered for 8 hours with a paint shaker, followed by coating the application liquid for an electric charge generation layer with the dip coating device and drying the liquid thus coated with hot air for 10 minutes at a drying temperature of 90° C. to provide the electric charge generation layer to a dried thickness of 0.8 μm. Further, a mixture of 8 parts by weight of dichloromethane, 1 part by Gweight of hydrazone compounds (4-diethylaminobenzaldehyde-N,N-diphenylhydrazone: having above chemical formula (II)) and 1 part by weight of polycarbonate resin (manufactured by Mitsubishi Gas Co. Ltd. Upiron) was stirred and dissolved with a magnentic stirrer, followed by coating the application liquid for an electric charge transport layer with the dip coating device and drying the liquid thus coated with hot air for 1 hour at a drying temperature of 80° C. to provide the electric charge transport layer to a dried thickness of 20 μm so that a multi-layer type electrophotographic photoconductor was manufactured.

The electrophotographic photoconductor thus manufactured was loaded on an actual copying machine (manufactured by Sharp Kabushiki Kaisha: SF-8100) to perform an image evaluation. Table 13 shows the result of the evaluation.

EXAMPLE 28

Example 28 of the electrophotographic photoconductor was manufactured in the same manner as Example 27 except that the solvent of the application liquid for the undercoating layer was replaced with a mixed solvent of 41 parts by weight of methyl alcohol and 41 parts by weight of 1,2-dichloroethane to perform the same image evaluation as Example 27.

Table 13 shows the result of the evaluation.

EXAMPLE 29

Example 29 of the electrophotographic photoconductor was manufactured in the same manner as Example 27 except that the resin for the undercoating layer was replaced with copolymer nylon resin (manufactured by Toray Industries, Inc.: CM8000) and the solvent of the application liquid for the undercoating layer was replaced by 41 parts by weight of methyl alcohol and 41 parts by weight of dichloroethane to perform the same image evaluation as Example 27.

Table 13 shows the result of the evaluation.

Comparative Example 39

Comparative Example 39 of the electrophotographic photoconductor was manufactured in the same manner as Example 27 except that the solvent of the application liquid for undercoating layer was used a single solvent of 28 parts by weight of methyl alcohol to perform the same image evaluation as Example 27.

Table 13 shows the result of the measurements.

EXAMPLES 30 AND 31

Examples 30 and 31 of the electrophotographic photoconductor were manufactured in the same manner as Examples 27 and 28 except that pot life in the application liquid for the undercoating layer has passed 30 days to perform the same image evaluation.

Table 13 shows the result of the evaluation.

Comparative Examples 40

Comparative Example 40 of the electrophotographic photoconductor were manufactured in the same manner as Examples 39 except that pot life in the application liquid for the undercoating layer has passed 30 days to perform the same image evaluation.

Table 13 shows the result of the evaluation.

[TABLE 13]

| photo-conductor | liquid for undercoating layer | | irregularities of undercoating layer | | image irregularities | | |
|---|---|---|---|---|---|---|---|
| | scatter-ing | pot life | liquid lopping | cyclo-irreg. | liquid lopping | cyclo-irreg. | fine texture |
| Example 27 | ++ | 0 day | ++ | ++ | ++ | ++ | ++ |
| 28 | ++ | 0 day | ++ | ++ | ++ | ++ | ++ |
| 29 | ++ | 0 day | ++ | ++ | ++ | ++ | + |
| 30 | ++ | 30 day | ++ | ++ | ++ | ++ | ++ |
| 31 | ++ | 30 day | − | − | ++ | + | ++ |
| Comparative 39 | − | 0 day | − | − | − | − | − |
| Example 40 | − | 30 day | − | − | − | − | −− |

Evaluation of irregularities:
++ with no irregularities
+ practically acceptable
− with some irregularities
−− extremely inferior As apparent from the above result, the dispersing properties and stability of the application liquid can be improved by using a mixed solvent in accordance with the present invention as a solvent for the application liquid for the undercoating layer, thereby providing an electrophotographic photoconductor having a favorable image properties free from application irregularities.

What is claimed is:

1. An electrophotographic photoconductor comprising:

a conductive support, an undercoating layer formed on the conductive support, and a photosensitive layer laminated on the undercoating layer, wherein the undercoating layer comprises non-conductive titanium oxide particles having a resistance of $10^5$ Ω·cm or more with respect to 100 kg/cm$^2$ of smashed particle and an average particle diameter of 1 μm or less and a polyamide resin, the content of the non-conductive titanium oxide particles is 80 to 99 wt % of the undercoating layer, and the undercoating layer has a thickness of 0.5 to 4.8 μm provided the content of the non-conductive titanium oxide particles in the undercoating layer is A wt % and the undercoating layer has a thickness of B μm satisfying the following equations:

$$0.5 \leqq B \leqq 0.2A-15 \text{ and } 80 \leqq A \leqq 99.$$

2. The electrophotographic photoconductor of claim 1 wherein the non-conductive titanium oxide particles are devoid of surface treatment.

3. The electrophotographic photoconductor of claim 1 wherein the non-conductive titanium oxide particle comprises titanium oxide particles coated with $Al_2O_3$.

4. A method for manufacturing the electrophotographic photoconductor comprising a conductive support, an undercoating layer formed on the conductive support, and a photosensitive layer laminated on the undercoating layer, wherein the undercoating layer comprises non-conductive titanium oxide particles having a resistance of $10^5$ Ω·cm or more with respect to 100 kg/cm$^2$ of smashed particle and an average particle diameter of 1 μm or less and a polyamide resin, the content of the non-conductive titanium oxide particles is 80 to 99 wt % of the undercoating layer, and the undercoating layer has a thickness of 0.5 to 4.8 μm provided the content of the non-conductive titanium oxide particles in the undercoating layer exhibits A wt % and the undercoating layer has a thickness of B μm satisfies the following equations:

$$0.5 \leqq B \leqq 0.2A-15 \text{ and } 80 \leqq A \leqq 99$$

comprising the steps of;

(a) dispersing said non-conductive titanium oxide particles and a polyamide resin into a mixed solvent of a lower alcohol selected from the group consisting of methanol, ethanol, isopropyl alcohol and n-propylalcohol and an organic solvent selected from the group consisting of chloroform, 1,2-dichloroethane, dichloromethane, trichlene, carbon tetra-chloride, dimethylformamide and 1,2-dichloropropane;

(b) applying the resulting mixture to a conductive support to form an undercoating layer; and (c) forming a photoconductive layer on the undercoating layer.

5. The method of claim 4 wherein the mixture of the lower alcohol and the organic solvent is an azetropic mixture.

6. The method of claim 4 wherein the solvent step (b) is a mixture of methanol and 1,2-dichloroethane.

7. The method of claim 4 wherein the polyamide resin is a copolymer nylon resin, a methoxymethylated resin or a mixture of the two.

* * * * *

UNITED STATES PATENT AND TRADEMARK OFFICE

CERTIFICATE OF CORRECTION

PATENT NO. : 5,391,448
DATED : February 21, 1995
INVENTOR(S) : KATAYAMA et al

It is certified that error appears in the above-identified patent and that said letters patent is hereby corrected as shown below:

Title page, Item [75] add the following inventors:

Hiroshi Sugimura, Osaka; Kazushige Morita, Nara-ken; Satoshi Nishigaki, Nara-ken; Kazuhiro Emoto, Kyoto, all of Japan Signed and Sealed this Twenty-fifth Day of July, 1995

*Attest:*

Bruce Lehman

BRUCE LEHMAN

*Attesting Officer*

*Commissioner of Patents and Trademarks*